United States Patent [19]

Hall

[11] Patent Number: 4,550,952

[45] Date of Patent: Nov. 5, 1985

[54] MINING MACHINE WITH ADJUSTABLE HOOD-SCOOP ASSEMBLY

[76] Inventor: Harvey Hall, 2680 Spring Valley Rd., Huntington, W. Va. 25704

[21] Appl. No.: 528,061

[22] Filed: Aug. 31, 1983

[51] Int. Cl.[4] ..... E21C 27/24

[52] U.S. Cl. ..... 299/64; 299/31; 299/69; 175/96; 173/64; 406/152

[58] Field of Search ..... 299/18, 64, 31, 69, 299/12; 175/96, 95; 173/64, 52, 59; 406/152

[56] References Cited

U.S. PATENT DOCUMENTS

| | | | |
|---|---|---|---|
| 900,951 | 10/1908 | Proctor | 175/96 |
| 1,075,027 | 10/1913 | Ebbley | 173/52 |
| 2,375,689 | 5/1945 | Reeder | 299/18 |
| 2,800,316 | 7/1957 | Henderson | 299/18 |
| 3,005,627 | 10/1961 | Tinlin | 299/18 |
| 3,362,752 | 1/1968 | Densmore | 299/18 |
| 3,743,356 | 7/1973 | Sheets | 299/18 |
| 3,857,490 | 12/1974 | Wilcox | 299/18 |

*Primary Examiner*—Stephen J. Novosad
*Assistant Examiner*—Michael A. Goodwin
*Attorney, Agent, or Firm*—Russell, Georges Breneman, Hellwege & Yee

[57] ABSTRACT

The invention disclosed herein is a mining machine with an adjustable hood-scoop assembly. The machine provides a means to remove coal from the face of a seam and extract the removed coal to a position removed from the mining area utilizing a vacuum system. The instant mining machine encloses the total face of the mine seam and acts to remove all solid and gaseous material from the mining area. Use of this apparatus in the mining of coal will provide better insurance for a healthy methane-free environment for the miner. The hood-scoop assembly is constructed to provide both horizontal and vertical moving plates so as to encompass totally the area contacted by the coal removal means, such as a multitude of air hammers. The machine is both braced and made mobile by means of vertical hydraulic jacks. Hydraulic cylinder means on the hood-scoop assembly are provided with specific trackways to insure four-way movement of the adjustable plates as shown in FIGS. 1, 2, 4 and 7.

19 Claims, 8 Drawing Figures

FIG. 1
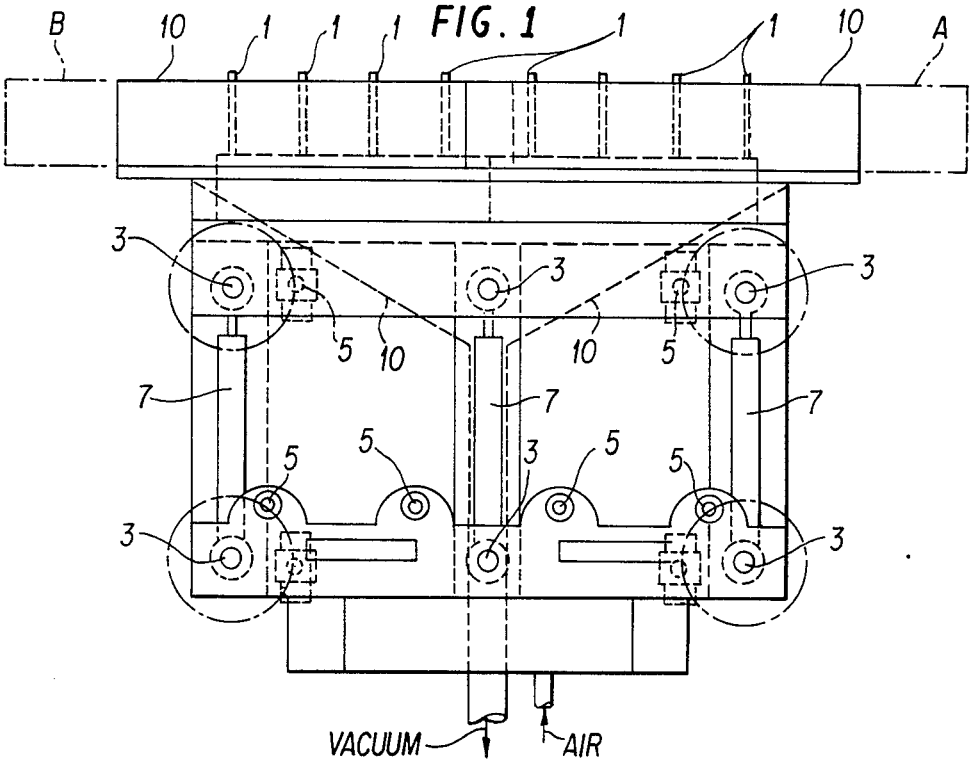
FIG. 2
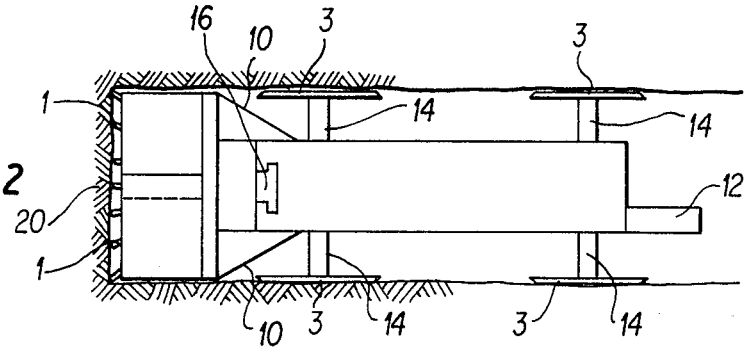
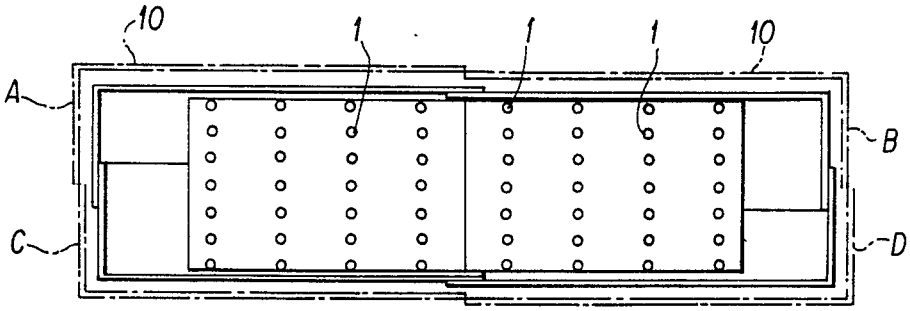
FIG. 3

MINING MACHINE WITH ADJUSTABLE HOOD-SCOOP ASSEMBLY

FIELD OF INVENTION

The field of this invention concerns continuous deep mining of coal, especially as the same relates to the problem of air-born coal dust particles in the vicinity juxtaposed to the working area of the coal seam. The field of this invention also concerns the continuous deep mining of coal, especially as it relates to the problems of: transporting coal from the mine face to the land surface, the removal of hazardous gas and dust from the mine, providing sufficient fresh air to the immediate work area, elimination of high voltage electricity from the work area, protection of the environment in the vicinity of the mine, and the extraction of coal at a price which is competitive with that of other fuels. It is a well-known fact that indigenous problems of ubiquitous methane gas accumulation during the work of a deep shaft coal mine seam are of critical importance in the prevention of mine disasters. For many years detection devices have been available or developed in order to determine the extent of methane gas accumulation in a mine. Notwithstanding, mining disasters occur repeatedly causing much loss of life, imposing great liability on the part of the family of the miners and the mine owner/operator.

It is most advantageous to provide a machine for coal removal wherein the problem of methane gas will be eliminated from the deep shaft mine at the very place of work. By this invention, methane gas is transported to an environment extrinsic from the mining area, such as ambient air.

It is highly advantageous in mining coal that an inexpensive method be developed for the extraction and transmission of mined coal to an outside bin accessible for further transmission of the coal. As set forth in the prior art section which follows this discussion, there is nothing magical or novel about the use of a pneumatic conveyance system for the transport of coal or methane material from the area where the coal is mined to a point extrinsic therefrom. However, the prior art has failed to recognize or take cognizance of the importance and viability of an adjustable hood-scoop assembly, wherein four different plates are arranged for movement via hydraulic cylinder means to completely encompass the mine seam where the mine removal technique is performed. It would also be most advantageous if a system could be provided for the total surface installation of all electrical motors and internal combustion engines so that only pneumatic and/or hydraulic means is existent at the mine seam.

It is also necessary to provide movement means for the mine removal equipment and adjustable hood-scoop assembly. The same can also serve as vertical jacks to support the mine tunnel. It is believed that this apparatus will provide a more viable and safer technique of mining, which will at least eliminate some of the hazards indigenous to this line of work.

PRIOR ART

Candor compels a recognition of applicable prior art of which there is actual cognizance. Without resort to a chronological discussion of the references, nor a rendition of the applicable pertinency of the prior art to the instant invention, the following is believed a succinct lithany of known patent disclosures concerning the use of pneumatic coal transport systems developed for below ground use or deep shaft mining.

In 1973 a patent issued to Sheets, U.S. Pat. No. 3,743,356, which confronted the problem of face ventilation for a continuous mining system in order to remove indigenuous and extrinsic coal dust from a mine face subsequent to its contact with rotary ripper heads. The basic machine is propelled by means of tracks which traverse along the mine floor from one working area to another. Rotary cutter drums or ripper heads contact the coal seam working face after the devices are moved in position. The coal is dislodged by the cutting and breaking action of the individual ripper heads. The same are supported on the chasis of the continuous mine processing apparatus. As the coal falls, it is received by a gathering pan which is intercommunication with a conveyor to move the coal in a rearward manner.

A hood enclosure, which has an open forward end, is located as close as possible to the ripper head mechanism and is hinged and surmounts the coal processing conveyor and subsequent pulverization entities. And the same is utilized in order to render the lump coal in a form more suitable for pneumatic pipeline passage. An axially disposed auger is placed in the lowermost portion of the hood structure wherein the coal particles after pulverization are small enough to enter into an air suspension that is ultimately fed through a pan chamber and then to a storage bin via a discharge pipe. The hood is surmounted over the entire continuous mining machine. This permits exorcism of any dust-ladden air in combination with heavier coal particles and the processing of both in order to remove the same from the mining area underground.

Approximately twenty-eight (28) years previous to the issuance of the Sheets patent, U.S. Pat. No. 2,375,689 issued to Reeder, whereby a coal vein is pulverized and the pulverized coal removed by suction. A grinding wheel is provided to grind the face of a coal vein to a finely pulverized coal dust. This coal dust is transmitted to a point removed from the seam face by means of a flexible suction conduit which is in direct communication with the rearward portion of the grinding wheel. Ambient air is sucked in immediately adjacent the grinding wheel by means of an exhaust motor attached to the far extremity of the flexible vacuum conduit. A screening means is provided in order to eliminate large chucks of coal from passage into the flexible vacuum conduit without first undergoing pulverizing.

Approximately six (6) months subsequent to the Sheets patent, a patent was issued concerning a method of pneumaticly conveying coal by means of the degree of coarseness of the coal particles. This patent, to Wilcox, U.S. Pat. No. 3,857,490, is classified in Class 209 which generally relates to the separation of solid particulate matter. Cognizance is taken therein of the aforementioned Reeder patent. This disclosure is really a refinement in re the pneumatic transfer of materials wherein coarse and fine particles are separated in the flexible conduit by means of a screen and impeller. Succinctly, the smaller particles will transverse the screen and be jettisoned by the impeller to a fine coal conduit in deference to the larger particles which are via the action of gravity transmitted to the lower portion of a holding tank. It is contemplated that many of these separation units may be provided in series to concoct a continuous conveyor system. The digging apparatus of Wilcox is in direct communication with the vacuum conduit to pneumaticly form a conveyor which removes both the fine and the coarse particles from the mine face.

In 1961 U.S. Pat. No. 3,005,627 issued to Tinlin for a tunneling machine having a suction exhaust means. Air hammers are provided to remove rock or other material from the face of the solid material. Surrounding these air hammers is axially positioned an air hood or shield which is by necessity of smaller diameter than the tunnel. As the air hammers or cutters operate against the tunnel face, a hollow central shaft is continuously rotated to insure that the entire surface area of the tunnel face is removed continuously. The material extracted from the tunnel face is removed through the air shield to move radially inward and rearward through openings in the air shield surrounding the air hammers. In this manner, pulverized rock from the tunnel face is continuously and uniformly removed and transmitted rearwardly via a pneumatic transport means.

In 1968 U.S. Pat. No. 3,362,752, issued to Densmore disclosing a pneumatic conveyance system which is situated downstream of cutter units and an endless chain conveyor means to remove debris via pneumatic transport to a site outside of the mining area. The conveyor system is provided with mobility so as to follow the cutter and conveyance plus a pulverizing system through a bored-out area of the mine. Finally, in 1968 a patent issued to Ziemba, U.S. Pat. No. 3,387,889 which disclosed the use of a duct-like air chamber which is positioned adjacent the cutter heads of a mining machine and activated so as to create a vacuum to suck out any dust ladden air into a slurry area. Even in this plethora of references there is no disclosure of utilizing a completely adjustable hood-scoop for the advantageous extraction of all coal removed from a seam via air hammers as is more fully embodied in the description of the instant drawings.

OBJECTS AND EMBODIMENTS

One embodiment of this invention comprises an apparatus and a pneumatic coal mining machine which comprises a longitudinal mobile chasis having a pneumatic or compressed air inlet means and a vacuum outlet means at one extreme of said chasis, a pneumatic coal removal and pulverization means at the opposite extreme of said chasis to remove coal from a face of coal, and adjustable hood-scoop situated around the substantially complete perimeter and in juxtaposition with respect to said removal and pulverization means, and a vacuum conveyor means for extraction of (1) substantially all of said coal removed from said face and (2) indigenous gases created by said coal removed. In combination with this system an air cleaning system is provided for the removal of coal and dust before discharge of the air to its ambient environment.

Another embodiment of this invention resides in a mining apparatus which comprises only pneumatic means and hydraulic means in the mine work area for removal of said coal from a seam of coal and conveyance of said removal coal to an area segregated from the work area.

It is therefore an object of this invention to provide a new and novel mining apparatus for the safer obtention of coal mineral from a deep shaft work area.

It is also an object of this invention to provide a mining machine whereby all electrical motors and internal combustion engine parts are situated at the surface installation of the mine.

A further object of this invention resides in a vacuum system having an adjustable hood-scoop assembly to totally enclose the face of a seam of coal being mined, whereby air is continuously being pulled into the hood-scoop assembly and a vacuum is formed to thereby remove all possible methane and/or dust from the work area and also to remove the coal particles to a bin serviceable by other coal movement means, such as railroad coal cars or surface-situated endless conveyors. An air cleaning system is provided at the surface of the mine where all solids are removed prior to the air being exhausted to the ambient atmosphere.

Another object of this invention is to provide a mining machine where nearly all of the moving parts are hydraulic air jacks or air hammers to ensure quick repair or replacement of an inoperable part and therefore eliminate the malfunction down-time of the apparatus at the coal seam.

Yet another object of this invention is the provision for a mining technique wherein constant spraying of water at the mine face is eliminated to provide a dryer, safer work place.

Finally, another object of this invention is to provide an apparatus and method of mining wherein reduction of man hours per ton can be achieved thereby making coal a more competitive fuel over other natural and synthetic fuel and making domestic coal more competitive with that mined in other countries such as Poland, Japan and Australia.

GENERAL DESCRIPTION OF THE INVENTION

The above objects of this invention are achieved as a derivative result of the adjustable hood-scoop assembly which is depicted in the instant drawings and which provides for a tight and secure fit of all areas of the seam being mined so that the vacuum system can quickly and efficienctly transport any loosened material to a point extrinsic from the work area. Thus, this apparatus provides a total enclosure or a mini-environment of the mine area to contain and eliminate all hazardous materials therefrom.

BRIEF DESCRIPTION OF THE DRAWINGS

FIG. 1 is a top elevation view of the instant mining machine.

FIG. 2 is a side elevation view of the instant mining machine in use upon a seam of coal.

FIG. 3 is a front elevation view.

DETAILED DESCRIPTION OF THE DRAWINGS

Figure 4:
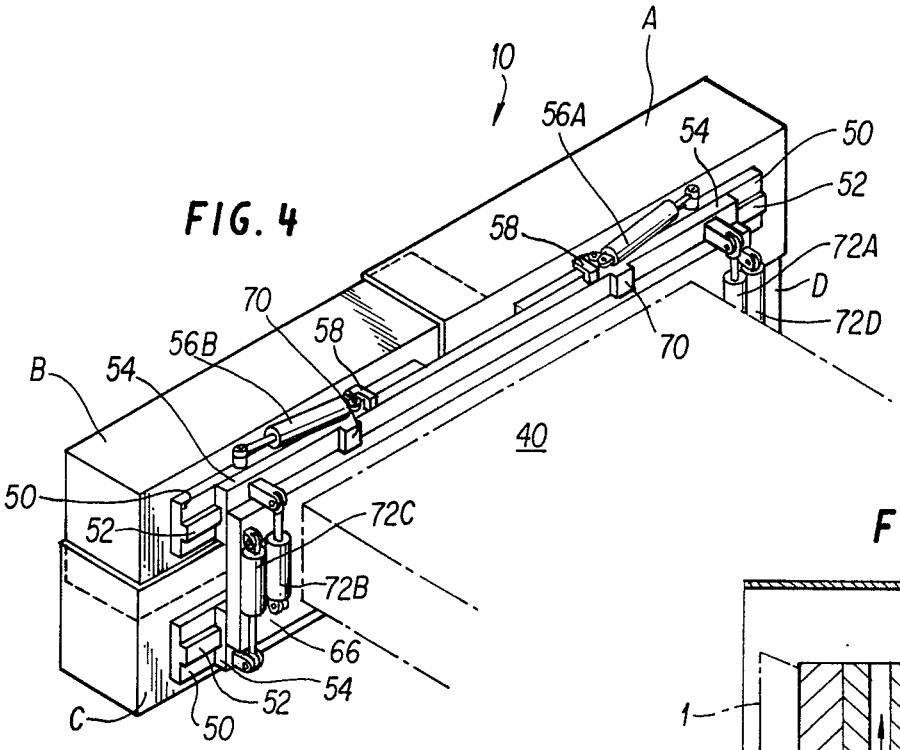
FIG. 4 is a back perspective view of the adjustable hood-scoop of this invention.

FIG. 1 is a view of the instant mining machine from a position elevated with respect to the overall chasis 1.

The dotted lines are shown for lines which can not be seen from above but are nevertheless existent.

The rear of the machine shows the ingress of pressurized air for hereinafter described purposes and egress of a vacuum line for removal of the air input, dangerous gases and mined or acquired minerals. One advantage of the machine is the situs of all electrical motors and internal combustion engines on the surface or at least removed to a point away from the area being mined. It is preferred that the pressurized air be used for all movable parts.

For this reason, the means for removal of the coal or other minerals from the mine seam is accomplished via air hammers 1. The hammers will be high speed reciprocating air activated chisels which tends to cleave-off or pulverize the coal to thereby remove it from the solid seam of the mineral shown as 20 in FIGS. 2 and 7. And during mining the unmined mineral 22 can be used as shaft supports. See FIG. 7. The air hammers are operated directly via the pressurized air.

The underground mining machine can move by rolling on casters 6 and can be propelled by an inch-worm or accordian method. Vertical pneumatic jacks 14 with jack pads 3 are mounted on each of the four corners of the chassis and each may be extended or retracted both above and below the chassis. Horizonal pneumatic cylinders 7 extend the length of the machine from front to rear. To move forward the rear vertical jacks are extended to prevent movement of the rear portion of the chassis. The horizonal front-to-rear cylinders are then extended. This moves the front portion of the chassis, which includes the front vertical jacks forward. The front vertical jacks are then extended, the rear vertical jacks are retracted, and the horizonal front-to-rear jacks are retracted to pull the rear portion of the chassis, which includes the rear vertical jacks, forward. The process is then reversed when the machine is moved backward.

The machine can turn in either direction by following the above procedure on only one side, or end, of the machine while either front or rear jack on the other side of the machine is extended to provide a pivot.

Other vertical jacks and horizonal cylinders may be added to the chassis as required by the size and weight of a machine which is necessary for the mining of a mineral bed of a particular height or density. Roof bolt machines 5 are used to provide top support after the chassis is established in a fixed position. Regardless of the position of the hydraulic cylinders 7, the hood-scoop will always remain juxtaposed to the mineral seam. The hood-scoop assembly 10 is movable and adjustable both vertically and horizontally. In this manner, the vacuum is always pulled juxtaposed to the seam of coal being mined.

Figure 5:
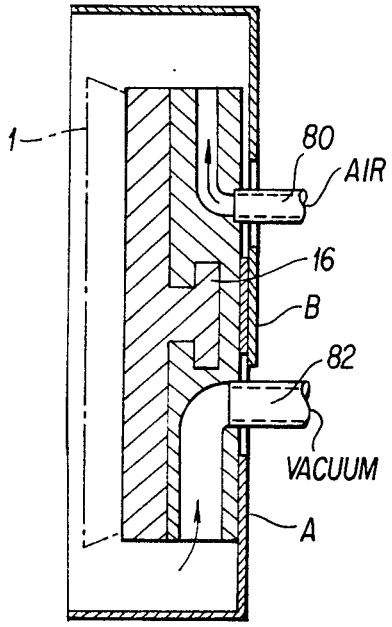
FIG. 5 is a side plan view of the center cut of the production assembly of the machine set in place.

In FIG. 2 the vacuum and pneumatic pressure lines are not shown but would be located at the extremity oppposite to coal seam 20. A platform 12 is provided for the position of an operator of the machine. Vertical jacks 3 are positioned against the roof of the mine shaft. A track way 16 is provided for the air-hammers. In operation the air flows through the machine to operate the air hammers pneumatically and to provide a vacuum for removal of air, dangerous gases and coal through the vacuum conduit. Of course, the vacuum is pulled in the direction away from the seam as shown in FIG. 5.

The crux of this invention is the four way adjustability of the hood-scoop. The scoop portion is disposed beneath the air hammers while the hood portion surmounts the same. FIG. 3 shows the four moving parts of the hood-scoop, A,B,C, and D. Entites A and B correspond to the respective portions of the hood in FIG. 1. The movement means of A through D are shown in FIG. 4 looking at the rear of the machine. These portions can be made to adjust on a horizontal or vertical dimension, the dotted lines indicating the ultimate flexibility point of hood movement.

Figure 6:
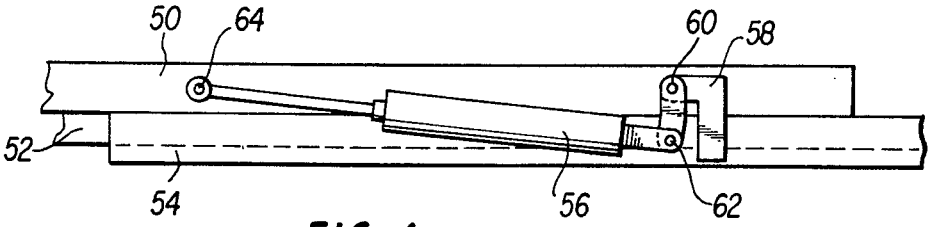
FIG. 6 is a plan view of the hydraulic cylinders and eccentric pivot joint that enables four way movement of the hood-scoop.

The back chasis 40 of the machines is shown in FIG. 4, the same having positioned therein the pneumatic air line and hammers, vacuum line, and other necessary functioning parts which are not essential parts of this invention. A fixed horizontal plate 50 is provided with a horizontal keyway 52. One long path on the top and bottom with respective keyways may be provided or the same may be bifurcated to form four individual units (two on top- two on the bottom). Note that the keyway for Plate D is not visible in the perspective rear view. An overriding horizontally moving plate 54 traverses the keyway or keyways. This horizontal movement is activated by a horizontal movement means which is usually (although not exclusively) a pneumatic or hydraulic cylinder with piston and cylinder as functioning parts. As each respective piston arm egresses from each respective cylinder, each respective plate moves horizontally as shown by the dotted line on Plate B. In other words, the hidden portion of the plate becomes smaller as the piston expands from the cylinder and vice-versa. A more exact description is shown in re plan view of FIG. 6. A mounting 58 is attached to an eccentric point 60, which in turn is in communication with a second eccentric point 62, to form an eccentric pivot of the cylinder. At the other extreme of the cylinder a third fixed point 64 is provided. It is readily apparent to anyone skilled in the art that extension of the piston i.e., pneumatically forcing the same out of the cylinder, will cause the eccentric pivoting action and thereby the traversal of horizontal plate 54 across horizontal keyway 52. Thus, all of the Plates A,B,C and D are capable of horizontal expansion and contraction.

Fixed plate 50 is attached to machine chasis 40. In this manner all of the plates also move individually vertically with respect to each other. Vertical quide 70 is provided attached to the fixed plate for traversal of the vertical plates. Four hydraulic cylinders 72A, 72B, 72C and 72D are shown as the vertical movement means. Each may be moved individual or in concert with one another. And each is attached at one end to the fixed plate or horizontal plate passing thereover and at the other extreme, at least indirectly, to the respective vertical plate which is to be adjusted. Each cylinder is nomenclated for the particular respective plate that it is responsible for moving. Thus, as each piston rod is elongated, the respective plate moves vertically up or down.

It can be clearly seen that all four plates move two ways via eight hydraulic cylinders (the horizontal cylinders for plates C and D, of the scoop portion are not shown). Thus, the hood-scoop can be adjusted to directly and snugly surround the air hammers.

In FIG. 5 the air inlet is denoted as 80 and the vacuum outlet as 82. The adjustable hood Plates A and B are shown but the plates beneath the air hammers 1 are not depicted. Air hammer trackway 16 is shown as set forth in FIG. 2. Thus, as the air enters at a pressure through conduit 80, it operates air hammers 1 (through other conduits) and is removed via vacuum tube 82 to a location adjacent from the area that is being mined. At first blush it may seem that the larger particles may not be viably removed simply from the use of the vacuum, however, it is contemplated that either screw crushers are situated at the openings in the vacuum conduit to pulverize the coal so that the vacuum will carry the coal particles and entrained gaseous material to the surface or in the alternative air hammers are reciprocated at such a high speed via the pneumatic air through conduit 80 that the coal is literally pulverized off the seam or wall and the screw crushers are not essential but do aid in the operability of the apparatus.

Figure 7:
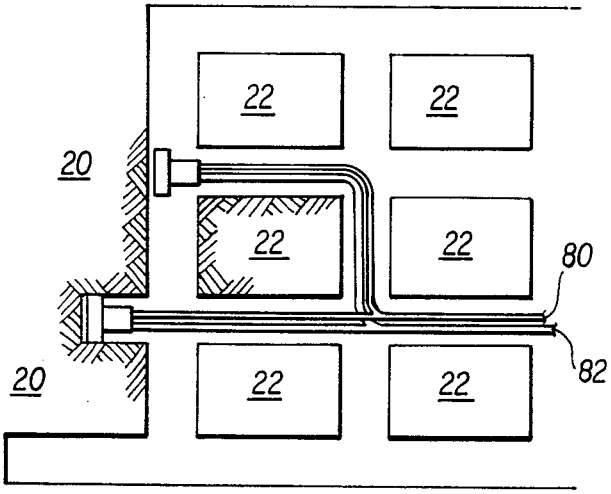
FIG. 7 is a view of a multiple number of mining machines in use in a deep shaft mine.

FIG. 7 shows a multiplicity of mining units operating with air and vacuum conduits 80 and 82 respectively. It is contemplated that these conduits may be present in a multiplicity for a multiple number of mining units or, in the alternative, one central conduit either 80 or 82, or both, can be utilized for each different mining machine. As shown in FIG. 7 the unmined coal can be utilized as support pillars 22 in order to prevent collapse of the coal shaft during mining operations. It is also contemplated that after the seam has been worked and it is no longer viable to pull the mined coal through vacuum 82, that the multiple mining machine may be withdrawn and some of the support shafts 22 mined in retreat.

Figure 8:
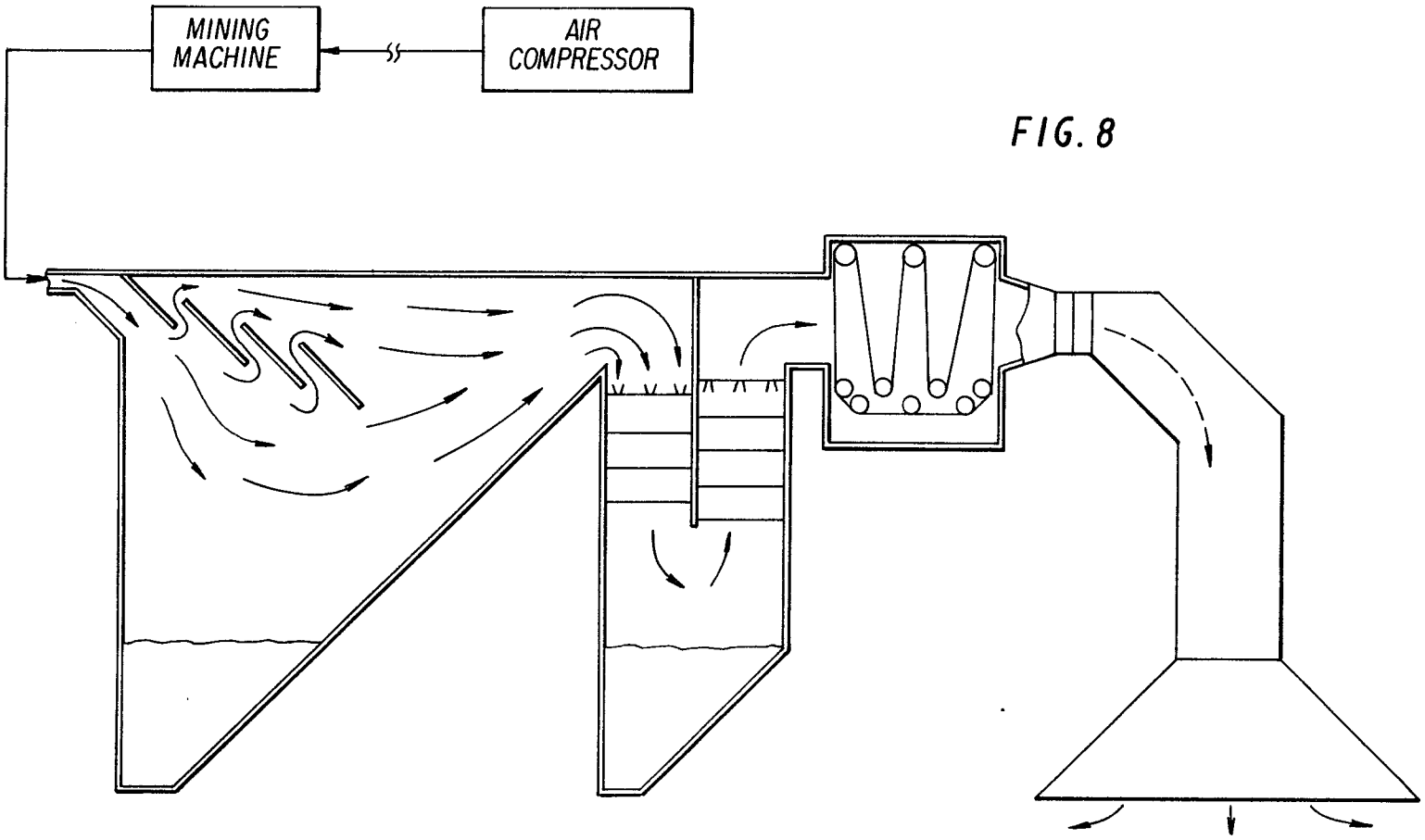
FIG. 8 is a process flow scenarior of the preferred embodiment of treating coal dust and air removed from the mine at a point extrinsic of the same.

FIG. 8 shows a portion of the machine extrinsic from the mining area. An air compressor 100 works in coordination with a mining machine 102, as above disclosed, via conduit 80 passing coal in a vacuum to the processing unit through conduit 82. The latter connects with a coal bin 104 possessing baffles 106 and a level of coal in the bottom 108. The air flow shown via the arrows passes to a dust bin 110. Sprinkles 112 are attached to provide an aqueous stream for removal of the coal from the air. The coal bin is divided into various spraying areas provided with contact plates to aid in coal extraction. The bottommost portion of the coal bin has a level of coal 114. The serpentine flow of vapor passes to a water tank 120 having a rotating screen 122 to prevent coal dust from entering fan 130. Conduit 132 connects with fan 130 to exhaust opening 134. The fan is of sufficient size to provide adequate vacuum for both the mining machine and vapor processing at the surface. The air stream exited from exhaust 134 is environmentally clean.

The instant drawings exemplify a viable adjustable hood-scoop as shown in the rearward perspective of FIG. 4 having the dotted lines showing at least two of the parameters of adjustability. All four Plates, A, B, C and D will act to move individually of one another or in concert with one another to surround the air hammers. It is this technique which allows a viable operating environment to fit snugly over the air hammers and positively withdraw all of the methane gas at the point of the mining seam. Other conventional techniques utilized in pneumatic mining of coal such as preliminary grinding wheels or pulverizing units in the bottom portions of the scoop feature of this invention have not been shown as being necessary for an understanding of this invention. FIGS. 1 through 7 are but a replica of the contemplated apparatus and its method of use and should not be viewed as a limiting factor upon the following claims.

What I claim as my invention is:

1. A pneumatic coal mining machine which comprises:

(a) a longitudinal mobile chassis having a pressurized air inlet means and a vacuum outlet means at one extreme of said chassis;

(b) pneumatic coal removal and pulverization means at opposite extreme of said chassis to remove coal from a face of coal;

(c) an adjustable hood-scoop situated surrounding the substantially complete perimeter in juxtaposition with respect to said removal and pulverization means said scoop comprising four separate plates, each of which has its position individually changed with respect to the perimeter of the seam of said coal being mined; and (d) a vacuum conveyor means for extraction of substantially all of said coal removed from said face and for removal of indigenous gases created by said coal removal.

2. The mobile mining machine of claim 1 wherein said pneumatic means functions to both remove the coal from the mine seam and convey the same to said area segregated from the work area.

3. The mining machine of claim 2 wherein said area segregated from the work area is located on the surface of a mine.

4. The pneumatic coal mining machine of claim 1 wherein said pneumatic coal removal and pulverizing means comprises a plethora of air hammers which reduce said coal to a particle size sufficient for passage through said vacuum conveyor means.

5. The pneumatic coal mining machine of claim 1 wherein said vacuum conveyor means is comprised of an elongated conduit of sufficient diameter to provide for passage of said pulverized coal particles to a spot segregated from the work area of the coal seam.

6. The pneumatic coal mining machine of claim 1 wherein indigenous gases created by said coal removal comprise methane which is immediately withdrawn via the vacuum to a spot where it is vented to the ambient atmosphere.

7. A mining machine which comprises:

(a) an elongated mobile frame member;

(b) a coal removal means at one extremity of said frame and in direct communication therewith;

(c) a pressurized air inlet means;

(d) a vacuum discharge outlet means;

(e) a hood-scoop of varying dimensions for enclosing said coal removal means against a seam of coal, wherein said hood-scoop possesses four plates which are operated independently of one another comprising:

(i) a first horizontal plate situated above and to the left with respect to said coal removal means and being in communication with a vertical and horizontal movement means;

(ii) a second horizontal plate situated above and to the right with respect to said coal removal means and being in communication with a vertical and horizontal movement means;

(iii) a third horizontal plate situated below and to the left with respect to said coal removal means and being in communication with a vertical and horizontal movement means;

(iv) a fourth horizontal plate situated below and to the right with respect to said coal removal means and being in communication with a vertical and horizontal movement means.

8. The mining machine of claim 7 wherein said first, second, third and fourth horizontal plates after adjustment take the configuration of the perimeter of the coal removal means and are situated flush with the seam of said coal.

9. The mining machine of claim 7 wherein said vertical and horizontal movement means in communication with said first, second, third and fourth horizontal plate comprises a hydraulic cylinder for each of said plates.

10. The mining machine of claim 9 wherein said cylinder is connected by means of an eccentric pivot joint for movement in the horizontal direction.

11. The mining machine of claim 7 wherein said first, second, third and fourth plates traverse either a horizontal or vertical keyway for respective vertical or horizontal movement.

12. The mining machine of claim 11 wherein the portion of the plates at the extremity other than flush with the seam of coal are connected to the front extremity of the mobile chasis.

13. The mining machine of claim 11 wherein said first and second horizontal plates and said third and fourth horizontal plates have a common horizontal keyway.

14. The mining machine of claim 11 wherein said first and third horizontal plates and said second and fourth horizontal plates have a common vertical keyway.

15. The mining machine of claim 7 wherein said coal removal means comprise a multitude of pneumatic air hammers for the removal and fine pulverization of coal in order to permit passage of said coal through said vacuum discharge outlet means.

16. The mining machine of claim 7 wherein a fixed plate is provided for anchoring each of the four vertical movement means with respect to the first, second, third and fourth plates.

17. The mining machine of claim 7 wherein said vacuum discharge outlet means is connected with a fan mounted outside of said mine to draw air through a shaft connected with the face of said mine wherein said vacuum is sufficient to withdraw entrained and pulverized coal from said face of said mine.

18. The mining machine of claim 7 wherein said hood-scoop assembly has a coal screw crusher in juxtaposition therewith to further reduce the size of the coal for vacuum transmission of said coal to a location extrinsic from said coal face.

19. A pneumatic coal mining machine which comprises:

(a) a longitudinal mobile chassis having a pressurized air inlet means and a vacuum outlet means at one extreme of said chassis;

(b) pneumatic coal removal and pulverization means at opposite extreme of said chassis to remove coal from a face of coal;

(c) an adjustable hood-scoop situated surrounding the substantially complete perimeter in juxtaposition with respect to said removal and pulverization means, said scoop comprising four independent plates which act in consort to surround said perimeter with respect to said removal and pulverization means; and (d) a vacuum conveyor means for extraction of substantially all of said coal removed from said face and for removal of indigenous gases created by said coal removal.

* * * * *